US006328018B1

(12) United States Patent
Akasaka et al.

(10) Patent No.: US 6,328,018 B1
(45) Date of Patent: Dec. 11, 2001

(54) CONTROL APPARATUS FOR CONTROLLING INTERNAL COMBUSTION ENGINE

(75) Inventors: Miyoko Akasaka, Tochigi; Yoshiaki Hirakata, Wako; Masahiko Abe, Wako; Yasuo Iwata, Wako, all of (JP)

(73) Assignees: Keihin Corporation; Honda Giken Kogyo Kabushiki Kaisha, both of Tokyo (JP)

( * ) Notice: Subject to any disclaimer, the term of this patent is extended or adjusted under 35 U.S.C. 154(b) by 0 days.

(21) Appl. No.: 09/323,847

(22) Filed: Jun. 2, 1999

(30) Foreign Application Priority Data

Jun. 3, 1998 (JP) ..... 10-154975

(51) Int. Cl.[7] ..... F02D 41/10
(52) U.S. Cl. ..... 123/487; 123/492
(58) Field of Search ..... 123/487, 492, 123/493

(56) References Cited

U.S. PATENT DOCUMENTS

| | | | | |
|---|---|---|---|---|
| 4,469,073 | * | 9/1984 | Kobayashi et al. | 123/492 |
| 4,706,632 | * | 11/1987 | Kasanami et al. | 123/492 |
| 4,781,163 | | 11/1988 | Jautelat et al. | 123/492 |
| 4,805,579 | | 2/1989 | Toshimitsu et al. | 123/492 |

FOREIGN PATENT DOCUMENTS 0 196 227 A2 10/1986 (EP) .

OTHER PUBLICATIONS

Abstract of Japanese Patent Publication No. 60252141, by Honda Motor Co., Ltd., dated May 30, 1984.

Abstract of Japanese Patent Publication No. 05059994, by Nippondenso Co., Ltd., dated Aug. 28, 1991.

* cited by examiner

*Primary Examiner*—Andrew M. Dolinar
(74) *Attorney, Agent, or Firm*—Arent Fox Kintner Plotkin & Kahn, PLLC

(57) ABSTRACT

The present invention provides a control apparatus for controlling an internal combustion engine that enables preferable acceleration in response to the running status of the internal combustion engine. When a computer which computes the fuel supply of the internal combustion engine at each engine cycle according to engine parameters detects a change in the throttle opening level of the internal combustion engine from a low opening level which is lower than a predetermined opening level to a non-low opening level which is higher than the predetermined level and when the computer detects that a variation $\Delta\theta_{TH}$ in the opening level of a throttle is equal to or greater than a predetermined value, the computer generates different increment correction values and corrects fuel supply according to the increment correction values.

2 Claims, 4 Drawing Sheets

CONTROL APPARATUS FOR CONTROLLING INTERNAL COMBUSTION ENGINE

BACKGROUND OF THE INVENTION

1. Field of the Invention

The present invention relates to a control apparatus for controlling an internal combustion engine that controls a fuel injector of the internal combustion engine.

2. Background Art

An apparatus disclosed in Japanese Patent Kokai No. 8-135491 is known as a controller which controls the amount of fuel injection to an automobile internal combustion engine based on the opening level of a throttle valve mounted to an intake system. The controller detects the opening level $\theta_{TH}$ of a throttle valve at each engine cycle and retrieves a fuel increment correction coefficient from a map in accordance with $\Delta\theta_{TH}=\sqrt[3]{}_{TH}$(current value)$-\theta_{TH}$ (previous value) which is the difference between $\theta_{TH}$ (previous value) detected previously and $\theta_{TH}$ (current value) detected currently. Then, the amount of fuel injection is determined by multiplying this fuel increment correction coefficient to a reference amount of fuel injection that is determined from the number of revolutions of an internal combustion engine and the intake manifold pressure.

OBJECTS AND SUMMARY OF THE INVENTION

A control apparatus mentioned above corrects and determines the reference amount of fuel injection only in accordance with the variation in the opening level of the throttle valve $\Delta\theta_{TH}$ irrespective of the current value of the opening level of the throttle valve. On the other hand, different amounts of fuel injection are required when an accelerating operation is started at a small throttle valve opening level, for example, when an automobile is accelerated from a standstill status or decelerating status, or when the accelerating operation is started at a large throttle valve opening level, for example, when an automobile is accelerated from an ordinary running status. However, in these cases, there was a problem in that the conventional control apparatus provided the same fuel increment correction coefficient by calculation if $\Delta\theta_{TH}$ was the same value.

In view of the foregoing, the object of the present invention is to provide a control apparatus for controlling an internal combustion engine that enables preferable acceleration in response to the running status of the internal combustion engine.

The control apparatus for controlling an internal combustion engine by the present invention comprises computing means for computing the fuel supply of the internal combustion engine at each engine cycle based on engine parameters of the internal combustion engine and control means for controlling a fuel injector to supply fuel to the engine according to the amount of fuel supply computed, which is characterized in that the computing means includes first means for generating a first signal when the first means detects a change in the throttle opening level of the internal combustion engine from a low opening level which is lower than a predetermined opening level to a non-low opening level which is higher than said predetermined level, second means for generating a second signal when the second means detects that a variation $\Delta\theta_{TH}$ in the throttle opening level is equal to or greater than the predetermined value, third means for generating an increment correction value differently when said first detection signal is generated and when said second detection signal is generated respectively, and fourth means f or correcting the amount of fuel supply according to said increment correction values.

According to an aspect of the present invention, the control apparatus for controlling an internal combustion engine allows the e engine e to be desirably accelerated in response to the running conditions of the engine because the increment correction values are generated differently when first and second detection signals are generated.

Additionally, according to another aspect of the present invention, the low opening level being in the totally closed status provides preferable acceleration even when the throttle valve is opened from the totally closed status.

Furthermore, according to another aspect of the present invention, an increment correction value is generated in response to the number of fuel injections counted from the time of generation of the first detection signal. Therefore, preferable acceleration is provided in the case of opening the throttle valve from the low opening level to a non-low level opening.

Still furthermore, according to still another aspect of the present invention, an increment t correction value is generated in response to variation $\Delta\theta_{TH}$ when the second detection signal is generated. Therefore, preferable acceleration is provided even when the throttle valve is opened from an opening level except for the low opening level.

DETAILED DESCRIPTION OF THE PREFERRED EMBODIMENT

Hereinafter, the embodiments of the present invention will be described with reference to the drawings.

Figure 1:
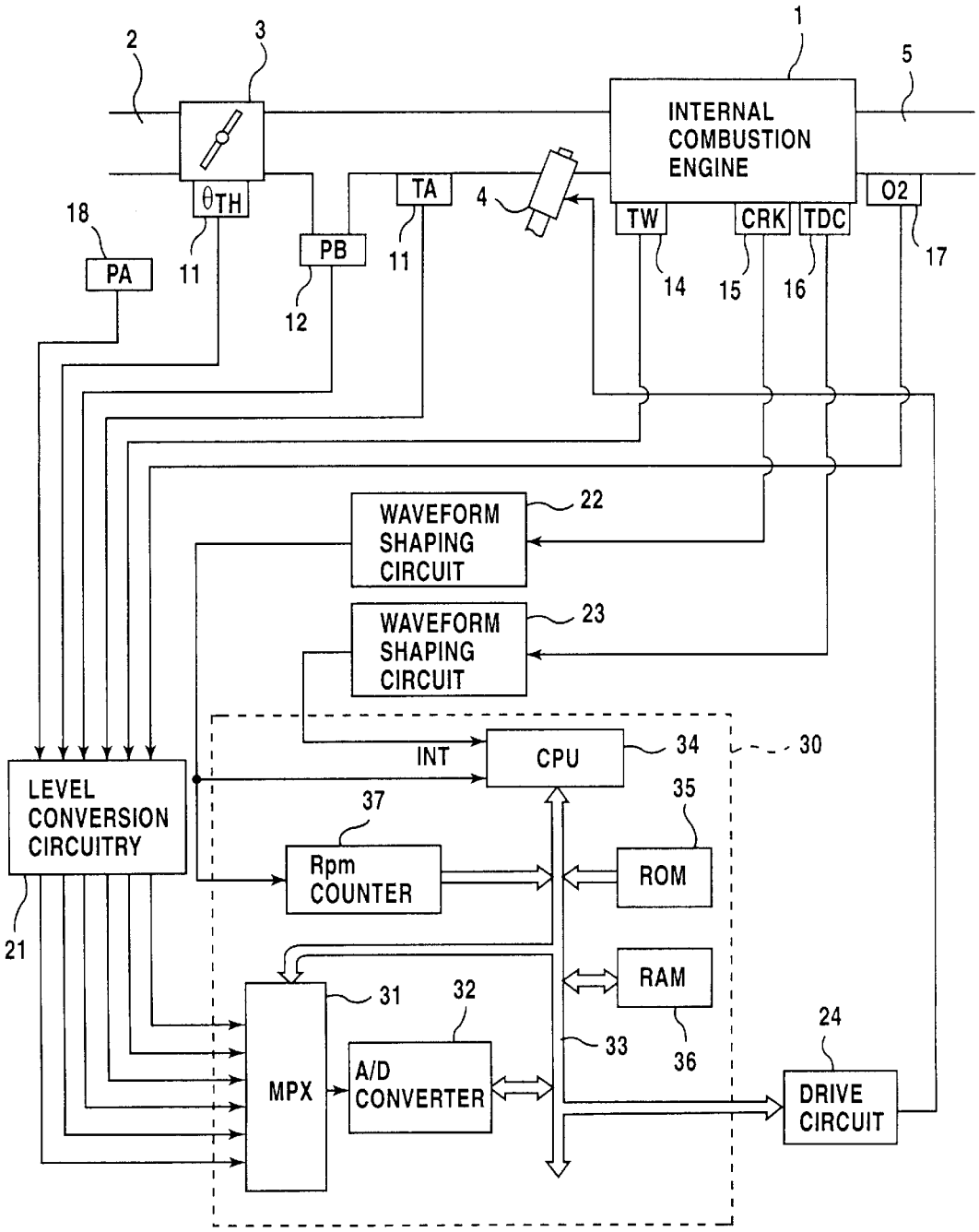
FIG. 1 is a schematic diagram showing the configuration of an internal combustion engine, intake system, exhaust system, and a control system of the internal combustion engine.

FIG. 1 shows the configuration of an internal combustion engine, intake system, exhaust system, and a control system of the internal combustion engine.

An intake system 2 of an internal combustion engine 1 is provided with a throttle valve 3 for controlling an air intake from the outside of a vehicle. The throttle valve 3 is provided with a throttle valve opening-level sensor 11 for detecting the opening of the throttle valve 3. Moreover, the intake system 2 is also provided with an intake pipe pressure sensor 12 for detecting the pressure of intake air and with an intake air temperature sensor 13 for detecting the temperature of intake air. Additionally, the intake system 2 is also provided with a fuel injector 4, whereby the internal combustion engine 1 sucks a mixture of intake air and fuel injected by the fuel injector 4 and then burns the intake air-fuel mixture to rotationally drive a crank shaft (not shown). The internal combustion engine 1 is provided with a cooling-water temperature sensor 14 for detecting temperature of the cooling water used for cooling the internal combustion engine. Near the crankshaft, there is a crank angle sensor provided for detecting the angle of the crankshaft, and a crankshaft reference angle sensor for detecting the reference angle of the crankshaft. The air-fuel mixture burnt in the internal combustion engine 1 is exhausted as exhaust gas to an exhaust system 5. The exhaust system 5 is provided with an oxygen concentration sensor 17 for detecting the oxygen concentration of the exhaust gas. In addition, near the internal combustion engine 1, there is provided an atmospheric pressure sensor 18 for detecting the atmospheric pressure.

Various types of sensors 11 through 14, 17, and 18 mentioned above send output signals to an electronic control unit 30 (hereinafter called the "ECU"). Output signals, sent from the throttle valve opening-level sensor 11, the intake pipe pressure sensor 12, the intake air temperature sensor 13, the cooling-water temperature sensor 14, the oxygen concentration sensor 17, and the atmospheric pressure sensor 18, are supplied to level conversion circuitry 21 in order to be converted into predetermined voltage signals, and then supplied to a multiplexer 31 (hereinafter called the "MPX") within the ECU 30. In accordance with commands sent from a CPU 34 at a predetermined timing, the MPX 31 selectively supplies, to an A/D converter 32, either one of the output signals sent from the throttle valve opening-level sensor 11, the intake pipe pressure sensor 12, the intake air temperature sensor 13, the cooling-water temperature sensor 14, the oxygen concentration sensor 17, or the atmospheric pressure sensor 18. The A/D converter 32 converts supplied signals into digital signals to supply the digital signals to an I/O bus 33. The I/O bus 33 allows the CPU 34 to input and output signals of data and address.

On the other hand, signals sent from the crank angle sensor 15 such as pulse signals generated at every 30 degrees of crank angle are supplied to a waveform shaping circuit 22 for waveform shaping, then to an interruption input of the CPU 34 and to an rpm counter 37. The rpm counter 37 outputs digital values according to the number of revolutions of the internal combustion engine. Output signals sent from the rpm counter 37 are supplied to the I/O bus 33. And, signals sent from the crankshaft reference angle sensor 16, such as pulse signals sent when the piston reaches the top dead center (hereinafter called the "TDC"), are supplied to a waveform shaping circuit 23 for waveform shaping, and then supplied to the interruption input of the CPU 34. The construction mentioned above allows the CPU 34 to detect the reference position of the crankshaft, the number of revolutions of the internal combustion engine, and the angle of the crankshaft.

A drive circuit 24 for driving a ROM 35, a RAM 36, and the fuel injector 4 is connected to the I/O bus 33. The CPU 34 sends fuel injection control commands to the fuel injector 4 for controlling a fuel injection valve (not shown) of the fuel injector 4, thereby controlling the fuel supply. In addition, the ROM 35 stores a program for detecting the opening level of the throttle valve 3 according to the flowchart shown in FIG. 2 and stores another program for retrieving increment correction values $T_{ACC}$ according to the flowchart shown in FIG. 3. Furthermore, ROM 35 stores a map that defines the relationship between the number of fuel injections and increment correction values $T_{ACC}$, which will be explained in FIG. 4.

The ECU 30 includes operating means, first means, second means, third means, and fourth means. In the explanation below, it is to be understood that variables and flags to be used in the CPU 34 have been completely initialized, for example, F1 has been initialized into 1, F2 into 0, F_TACC into 0, and n into 0, which will be described later. It is also to be understood that the internal combustion engine has completed necessary operations for start-up and has been in operation.

Figure 2:
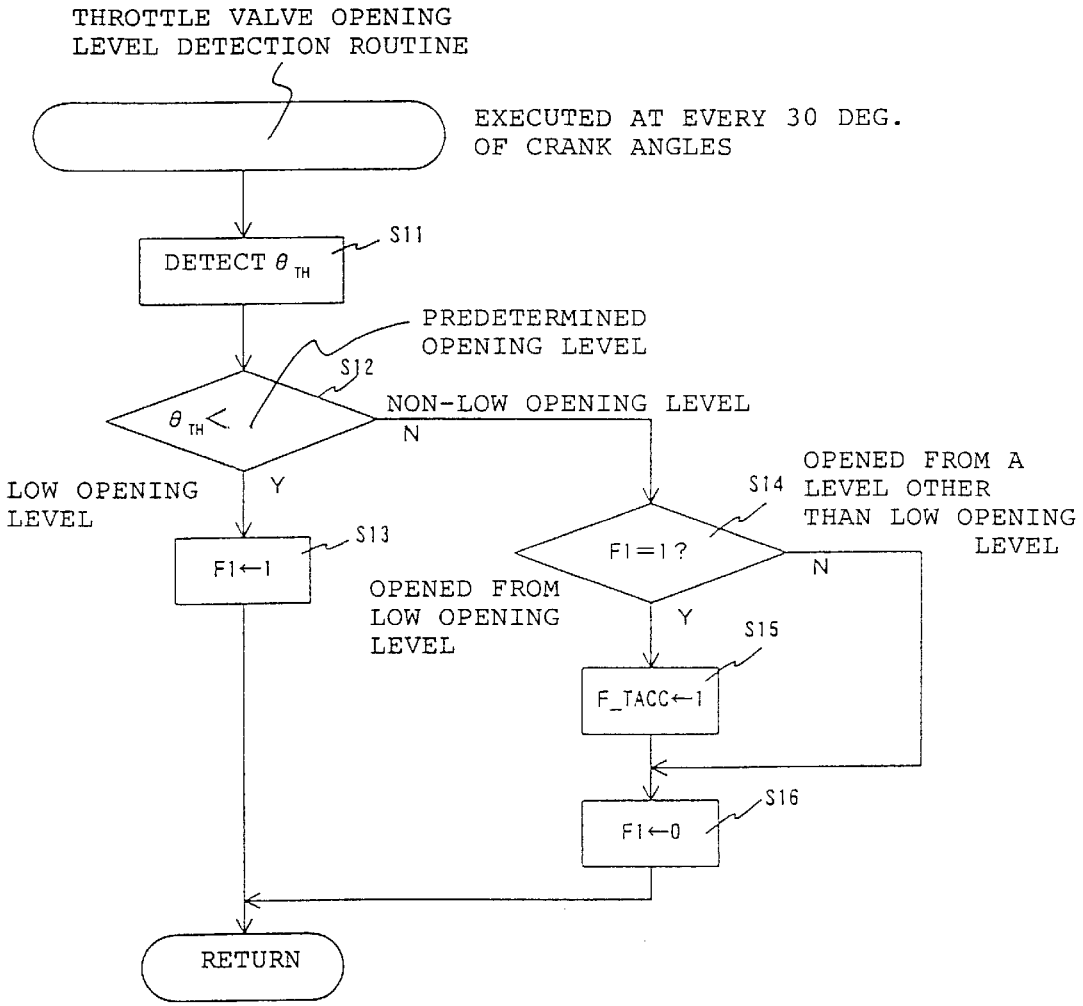
FIG. 2 is a flowchart showing a subroutine for detecting the opening level of a throttle valve.

FIG. 2 is a flowchart showing a subroutine for detecting the opening level of a throttle valve. This operation is carried out at predetermined intervals, for example, at every 30 degrees of crank angle.

First, a throttle opening level $\theta_{TH}$ of the throttle valve 3 is detected (step S11). Then, it is determined whether or not the throttle opening level $\theta_{TH}$ is at a predetermined opening level, for example, at an opening level smaller than 0.5 to 0.6 degrees such as that at a fully closed level (step S12). When the throttle opening level $\theta_{TH}$ is found to be smaller than a predetermined opening level, flag F1 is set to 1 (step S13) and then the present subroutine is ended. The flag F1 shows whether or not the throttle opening level $\theta_{TH}$ is at a low opening level which is lower than a predetermined opening level.

On the other hand, when throttle opening level $\theta_{TH}$ is found to be greater than a predetermined opening level, that is, at a non-low opening level in step S12, it is judged whether the value of the flag F1 is 1 or not (step S14). When the value of the flag F1 is found to be 1, the F_TACC is set to 1 (step S15), the flag F1 is set to 0 (step S16), and the present subroutine is ended. The flag F_TACC shows whether or not the throttle valve 3 has been opened from a low opening level which is lower than a predetermined opening level to a non-low opening level, and if the value of F_TACC is set to 1, a first detection signal is sent. On the other hand, when the value of flag F1 has been found to be not equal to 1 in Step S14, the flag F1 is set to 0 (step S16), and the present subroutine is immediately ended.

Figure 3:
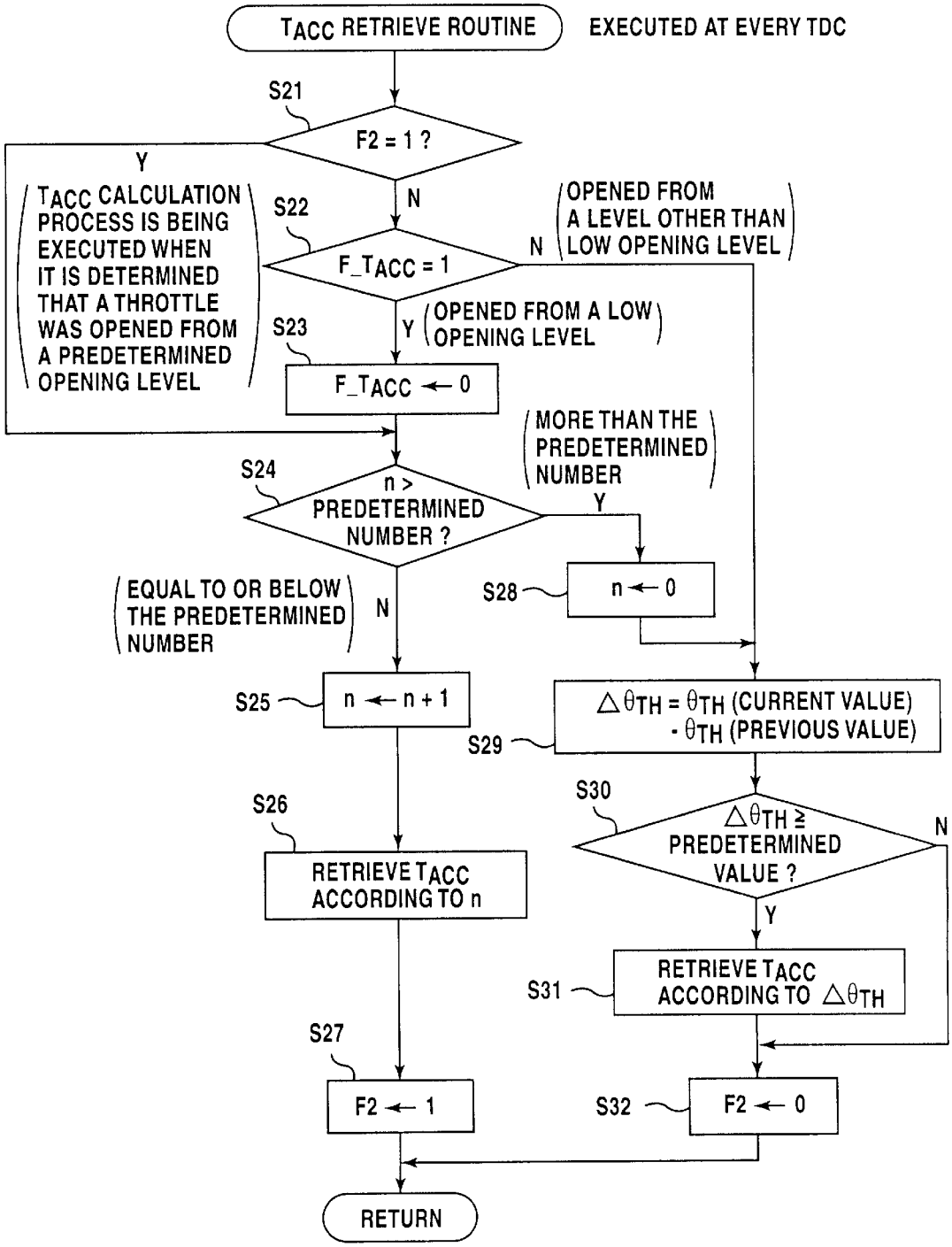
FIG. 3 is a flowchart showing a subroutine for retrieving increment correction values.

FIG. 3 is a flowchart showing a subroutine for retrieving fuel increment correction values TACC. This operation is executed at predetermined intervals of time, for example, at every TDC.

First, it is judged whether the flag F2 is equal to 1 or not (step S21). The flag F2 shows whether the retrieving processing of the $T_{ACC}$ is being executed or not which is carried out when the throttle valve has been opened from a low opening level. When it is found that the value of the flag F2 is not equal to 1, it is judged whether the flag F_TACC is equal to 1 or not (step S22). When the throttle valve 3 has been opened from a low opening level which is lower than a predetermined opening level, the flag F_TACC is determined to be equal to 1 and then the flag F_TACC is set to 0 (step S23). Subsequently, it is determined whether or not the number of fuel injections n, for example, 8 times is greater than a predetermined number of injections (step S24). The number of fuel injections n is counted after the throttle valve has been judged to be opened from a low opening level. When the number of fuel injections n is judged to be equal to or less than the predetermined number of injections, the number of fuel injections n is increased by 1 (step S25). Then, an increment correction value $T_{ACC}$ corresponding to the number of fuel injections is retrieved with reference to the relationship shown in FIG. 4 between the number of fuel injections n and increment correction value $T_{ACC}$ (step S26). Whereby, the flag F2 is set to 1 (step S27) and finally the present subroutine is ended.

Then, in the case of again executing the $T_{ACC}$ retrieving routine as shown in FIG. 3, the value of flag F2 is determined to be equal to 1 in step S21 because the value of flag F2 was changed to 1 at Step S27 when the present subroutine was previously executed. And, when the number of fuel injections n has been judged to be equal to or less than the predetermined number of fuel injections (step S24), the steps S25, S26, and S27 are executed and the present subroutine is ended. As mentioned above, when the throttle valve 3 has been opened from a low opening level which is lower than the predetermined opening level, the processing mentioned above will be executed repeatedly until the number of fuel injections n is determined to be greater than the predetermined number of fuel injections in step S24.

On the other hand, when the number of fuel injections n has been judged to be greater than the predetermined number of fuel injections in Step S24, the number of fuel injections n is initialized to 0 (step S28), and the difference $\Delta\theta_{TH}$ between the previously detected opening level $\theta_{TH}$ (previous value) of the throttle valve and the currently detected opening level $\theta_{TH}$ (current value) of the throttle valve is calculated (step S29). Then, it is judged whether or not $\Delta\theta_{TH}$ is equal to or greater than a predetermined value, for example, 0.3 degrees (step S30). When $\Delta\theta_{TH}$ has been determined to be equal to or greater than the predetermined value, a second detection signal is generated and an increment correction value $T_{ACC}$ corresponding to the A TH is retrieved from the related map between the $\Delta\theta_{TH}$ stored in the ROM 35 and increment correction value $T_{ACC}$ (step S31). Then the flag F2 is set to 0 (step S32) and the present subroutine is ended. On the other hand, when $\Delta\theta_{TH}$ has been determined to be smaller than the predetermined value in Step S30, the flag F2 is set to 0 (step S32) and the present subroutine is ended.

Further, the value of the flag F2 is equal to 0 and the value of the flag F_TACC is equal to 0, when the value of the flag F_TACC has not been set to 1 in Step S15 as mentioned above in FIG. 2, that is, when it has been judged that the present status is not the case where the throttle valve 3 has been opened from a low opening level which is lower than the predetermined opening level. Therefore, after the value of the flag F2 is judged to be not equal to 1 (step S21) and the value of the flag F_TACC is not equal to 1 (step S22) in FIG. 3, the processing of the steps S29, S30, and S31 is executed and the present subroutine is ended.

After the present subroutine has been carried out, the amount of fuel injection is calculated from an equation such as $T_{OUT}=T_0$ (NE, PB)$\times K_{TA}\times K_{TW}\times K_{PA}\times K_{022}+T_{ACC}$ in order to control the amount of fuel injection supplied by the fuel injector 4, where $T_0$ (NE, PB) is the reference amount of fuel injection calculated from the number of revolutions NE of the internal combustion engine and the intake manifold pressure PB, $K_{TA}$ is a correction coefficient for intake air temperature, $K_{TW}$ is a correction coefficient for the cooling water of the internal engine, $K_{PA}$ is a correction coefficient for the atmospheric pressure, and $K_{02}$is a correction coefficient for the concentration of oxygen contained in the exhaust gas.

In the embodiment mentioned above, the case of calculating the increment correction value $T_{ACC}$ as an addition correction term is shown, however, the increment correction coefficient $K_{ACC}$ may be calculated. In this case, $K_{ACC}$ is calculated not as an addition term but as a multiplication term, such as in $T_{OUT=T0}$ (NE, PB)$\times K_{TA}\times K_{TW}\times K_{PA}\times K_{02}\times K_{ACC}$.

Figure 4:
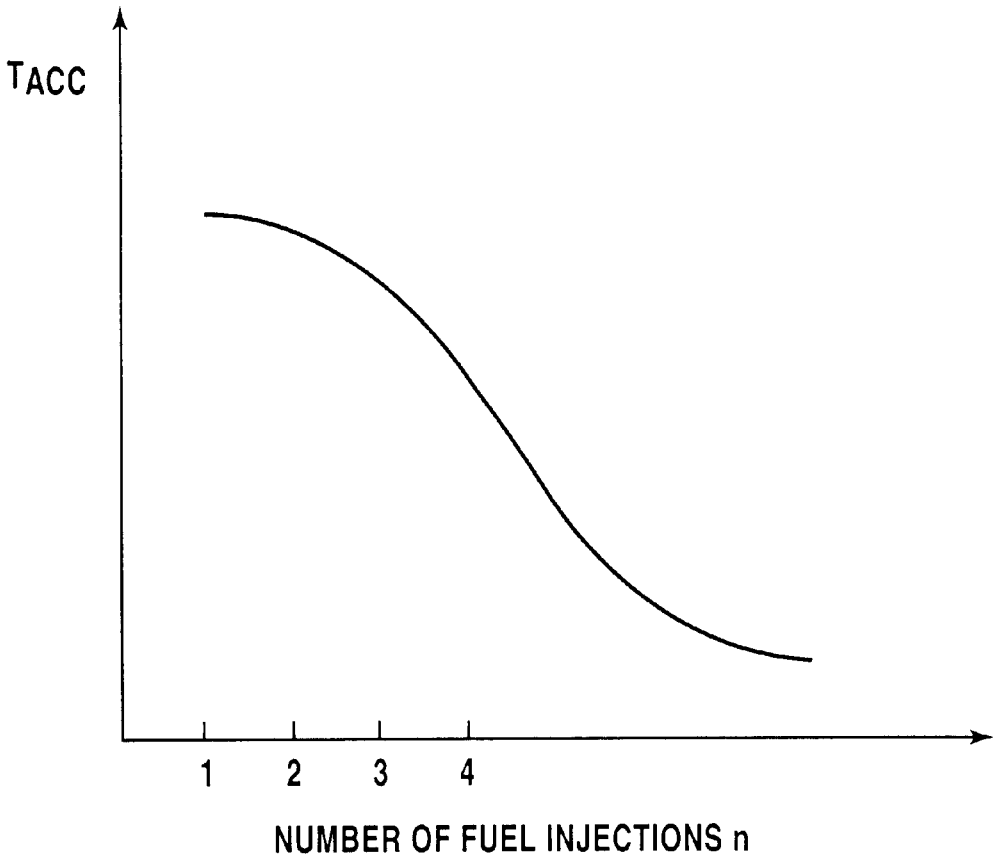
FIG. 4 is a graph illustrating the relationship between the number of fuel injections and increment correction values.

FIG. 4 is a graph illustrating the relationship between the number of fuel injections n and increment correction values $T_{ACC}$.

The increment correction value $T_{ACC}$ has the greatest value when the value of fuel injections n is equal to 1, and takes smaller values with an increasing number of fuel injections. Such a relationship between the number of fuel injections n and the increment correction value $T_{ACC}$ allows the internal combustion engine to be accelerated with desirable acceleration when the throttle valve is opened from a low opening level which is lower than the predetermined opening level. The relationship between the number of fuel injections n and the increment correction value $T_{ACC}$ is stored in the ROM 35 as a numerical map and is referenced in Step S26 in FIG. 3 mentioned above. This relationship has been determined, for example, by a pretest such as an actual engine test.

The internal combustion engine in the present specification includes an internal combustion engine which combusts fluid fuel such as a hybrid engine.

As described above, the control apparatus for controlling an internal combustion engine of the present invention allows the engine to be desirably accelerated in response to the running conditions of the engine because the increment correction values are generated differently when first and second detection signals are generated.

Additionally, according to another aspect of the present invention, the low opening level being in the totally closed status provides preferable acceleration even when the throttle valve is opened from the totally closed status.

Furthermore, according to another aspect of the present invention, an increment correction value is generated in response to the number of fuel injections counted from the time of generation of the first detection signal. Therefore, preferable acceleration is provided in the case of opening the throttle valve from the low opening level to a non-low level opening.

Furthermore, according to another aspect of the present invention, an increment correction value is generated in response to variation $\Delta\theta_{TH}$ when the second detection signal is generated. Therefore, preferable acceleration is provided even when the throttle valve is opened from an opening level other than the low opening level.

What is claimed is:

1. A control apparatus for controlling an internal combustion engine comprising computing means for computing the fuel supply of the internal combustion engine at each engine cycle based on engine parameters of said internal combustion engine and control means for controlling a fuel injector to supply to said internal combustion engine according to the amount of fuel supply computed, wherein said computing means includes;

first means for generating a first detection signal when said first means detects a change in a throttle opening level of said internal combustion engine from a low opening level which is lower than a predetermined opening level to a non-low opening level which is higher than said predetermined level, second means for generating a second detection signal when said second means detects that a variation $\Delta\theta_{TH}$ in said throttle opening level is equal to or greater than a predetermined value, third means for generating a first increment correction value at each fuel injection of a predetermined number of fuel injections from the generation of said first detection signal and thereafter generating a second increment correction value according to an amount of said variation $\Delta\theta_{TH}$ as long as said second detection signal is generated, and fourth means for correcting the amount of fuel supply in accordance with said second increment correction value.

2. The control apparatus for controlling an internal combustion engine according to claim 1, wherein said low opening level is a totally closed level.

* * * * *